US009358419B1

(12) United States Patent
Smith

(10) Patent No.: US 9,358,419 B1
(45) Date of Patent: Jun. 7, 2016

(54) PHYSICAL FITNESS DEVICE

(71) Applicant: Jonathan Smith, Nashville, TN (US)

(72) Inventor: Jonathan Smith, Nashville, TN (US)

( * ) Notice: Subject to any disclaimer, the term of this patent is extended or adjusted under 35 U.S.C. 154(b) by 59 days.

(21) Appl. No.: 14/208,731

(22) Filed: Mar. 13, 2014

Related U.S. Application Data

(60) Provisional application No. 61/787,053, filed on Mar. 15, 2013.

(51) Int. Cl.
*A63B 21/00* (2006.01)
*A63B 21/06* (2006.01)

(52) U.S. Cl.
CPC ..... *A63B 21/06* (2013.01); *A63B 21/0013* (2013.04)

(58) Field of Classification Search
CPC ..... A63B 23/1236; A63B 22/14; A63B 22/20
See application file for complete search history.

(56) References Cited

U.S. PATENT DOCUMENTS

| | | | | |
|---|---|---|---|---|
| 83,555 | A | 10/1868 | Shepard | |
| 1,824,920 | A | 9/1931 | Novak | |
| 2,821,394 | A | 1/1958 | Barbeau | |
| 3,134,590 | A | 5/1964 | Young | |
| 3,384,370 | A | 5/1968 | Bailey et al. | |
| 3,752,475 | A | 8/1973 | Ott | |
| 3,784,192 | A | 1/1974 | Nutter | |
| 3,796,431 | A | 3/1974 | Sinyard | |
| 3,809,393 | A | 5/1974 | Jones | |
| 4,134,584 | A * | 1/1979 | Rosenbusch | 482/93 |
| 4,339,127 | A | 7/1982 | Mitchell | |
| 4,768,778 | A | 9/1988 | Thomas, Jr. | |
| 4,892,305 | A | 1/1990 | Lynch | |
| 5,024,434 | A | 6/1991 | Smith | |
| D350,997 | S | 9/1994 | Connelly, III | |
| 5,407,405 | A | 4/1995 | Oren | |
| 5,632,707 | A | 5/1997 | Daniel et al. | |
| 5,692,996 | A | 12/1997 | Widerman | |
| 5,716,305 | A | 2/1998 | Selsam | |
| D428,454 | S | 7/2000 | Fischer et al. | |
| 6,129,651 | A | 10/2000 | Denaro | |
| D438,265 | S | 2/2001 | Fenelon | |
| D446,264 | S | 8/2001 | Fischer et al. | |
| D467,290 | S | 12/2002 | Chen | |
| D480,438 | S | 10/2003 | Walkow | |
| 6,629,913 | B2 | 10/2003 | Chen | |
| 6,702,723 | B2 | 3/2004 | Landfair | |
| 6,718,655 | B2 | 4/2004 | Sugawara | |
| D490,201 | S | 5/2004 | Liao | |
| 6,773,379 | B1 | 8/2004 | Bing | |
| 6,908,415 | B2 | 6/2005 | Branson | |
| D523,493 | S | 6/2006 | Horton | |
| D532,465 | S | 11/2006 | Mills et al. | |
| 7,229,392 | B2 | 6/2007 | Turnbull et al. | |
| 7,249,100 | B2 | 7/2007 | Murto et al. | |
| 7,377,888 | B2 | 5/2008 | Godbold | |
| 7,455,634 | B2 | 11/2008 | Barniak | |
| 7,468,025 | B2 | 12/2008 | Hauser et al. | |
| 7,470,224 | B1 | 12/2008 | Everett | |

(Continued)

OTHER PUBLICATIONS http://www.sciplus.com/p/3WHEEL-DOLLY_45821, first documented Apr. 27, 2013.*

*Primary Examiner* — Loan H Thanh
*Assistant Examiner* — Rae Fischer

(57) ABSTRACT

An exercise utilizes roller ball transfers for many embodiments, and those without, as well as an ability to add and remove weights thereto from above and possibly rotate in order to perform various exercises.

20 Claims, 13 Drawing Sheets

(56) References Cited

U.S. PATENT DOCUMENTS

| | | | | |
|---|---|---|---|---|
| 7,491,155 | B2 | 2/2009 | Fenelon et al. | |
| 7,503,884 | B1 | 3/2009 | Schall | |
| 7,537,766 | B2 | 5/2009 | Pavliak et al. | |
| 7,553,267 | B1 | 6/2009 | Hauser et al. | |
| 7,563,216 | B1 | 7/2009 | Kest | |
| D599,417 | S | 9/2009 | Friedman et al. | |
| 7,637,851 | B1 | 12/2009 | Lormil | |
| 7,637,855 | B2 | 12/2009 | Bizzell et al. | |
| 7,641,603 | B2 | 1/2010 | Lacher | |
| 7,645,218 | B2 | 1/2010 | Potok | |
| D620,540 | S | 7/2010 | McVay et al. | |
| 7,753,831 | B2 | 7/2010 | Langer et al. | |
| 7,780,585 | B1 | 8/2010 | Rivas | |
| D624,135 | S | 9/2010 | Tsai | |
| 7,793,431 | B2 | 9/2010 | Yu | |
| 7,798,943 | B1 | 9/2010 | Tsai | |
| D626,186 | S | 10/2010 | Tsai | |
| 7,824,319 | B2 | 11/2010 | Carlesimo et al. | |
| 7,850,585 | B1 | 12/2010 | Barboza | |
| D631,106 | S | 1/2011 | Zemel | |
| 7,878,951 | B2 | 2/2011 | Roman et al. | |
| 7,892,152 | B1 | 2/2011 | Teng | |
| 7,892,158 | B2 | 2/2011 | Varga | |
| 7,896,788 | B1 | 3/2011 | Schall | |
| 7,896,789 | B2 | 3/2011 | Hinton et al. | |
| 7,909,746 | B2 | 3/2011 | Gant | |
| 7,935,039 | B2 * | 5/2011 | Dannenberg | A63B 22/14 482/141 |
| 7,935,040 | B2 | 5/2011 | Moskowich | |
| 7,946,969 | B1 | 5/2011 | Friess et al. | |
| 7,972,250 | B2 | 7/2011 | Viselman | |
| 7,981,005 | B1 | 7/2011 | Tsai | |
| 7,981,016 | B1 | 7/2011 | Howard | |
| 8,016,732 | B2 | 9/2011 | Susnjara | |
| D647,580 | S | 10/2011 | Cen | |
| 8,043,198 | B2 | 10/2011 | Zhou | |
| D648,814 | S | 11/2011 | Chen | |
| D652,091 | S | 1/2012 | Gellatly et al. | |
| 8,100,815 | B2 | 1/2012 | Balaker et al. | |
| D653,714 | S | 2/2012 | Meininger et al. | |
| D654,544 | S | 2/2012 | Sliemers | |
| 8,137,250 | B1 | 3/2012 | Caban | |
| 8,147,391 | B1 | 4/2012 | Hill | |
| 8,157,713 | B1 | 4/2012 | Siskowic et al. | |
| 8,172,736 | B2 | 5/2012 | Contreras | |
| D662,558 | S | 6/2012 | Lovegrove et al. | |
| 8,197,392 | B2 | 6/2012 | Silverman et al. | |
| 8,267,694 | B1 | 9/2012 | Lamka | |
| 2005/0085352 | A1 | 4/2005 | Baxter | |
| 2005/0209072 | A1 | 9/2005 | Sheron | |
| 2005/0227831 | A1 | 10/2005 | Mills et al. | |
| 2006/0014615 | A1 | 1/2006 | Godbold | |
| 2006/0035771 | A1 | 2/2006 | Gant | |
| 2006/0040809 | A1 | 2/2006 | Godbold | |
| 2007/0184951 | A1 | 8/2007 | James et al. | |
| 2007/0298947 | A1 | 12/2007 | Eksteen | |
| 2009/0186751 | A1 | 7/2009 | Hauser et al. | |
| 2009/0298656 | A1 | 12/2009 | Dannenberg | |
| 2010/0130337 | A1 | 5/2010 | Stewart | |
| 2010/0261590 | A1 | 10/2010 | Fares | |
| 2010/0279833 | A1 | 11/2010 | Gant | |
| 2010/0317496 | A1 | 12/2010 | Abranchess | |
| 2011/0071008 | A1 | 3/2011 | Coates | |
| 2012/0258847 | A1 | 10/2012 | Lafferty | |
| 2012/0295775 | A1 | 11/2012 | Reid | |
| 2012/0309599 | A1 | 12/2012 | Miller, Jr. | |

* cited by examiner

PHYSICAL FITNESS DEVICE

CLAIM OF PRIORITY

This application claims the benefit of U.S. Provisional Patent Application No. 61/787,053 filed Mar. 15, 2013, which is incorporated by reference in its entirety.

FIELD OF THE INVENTION

The present invention relates to a physical fitness device and more preferably to a multi-use physical fitness device preferably equipped in many embodiments with roller ball transfers, and those without, as well as an ability to add and remove weights thereto and accessories therefore in order to perform various exercises.

BACKGROUND OF THE INVENTION

The present invention relates to physical fitness devices and more particularly to those such as which allow various exercises to be performed. Patents such as U.S. Pat. No. 3,809,393, U.S. Published Patent Application No. 2010/0130357, U.S. Pat. No. 5,632,707 and others show one use of physical fitness devices such as someone who is on their knees or feet in a plank position and using the devices in each hand to go up and down across the floor with their knees or feet on the ground. There are certainly other exercises which can be performed such as pushups, etc., with these style devices. However, most of the prior art is believed to be for a single use, namely, as a roller style device. The applicant believes that improvements can be had over these prior art designs.

SUMMARY OF THE INVENTION

Accordingly, it is a present object of the present invention to provide an improved exercise device.

It is another object of many embodiments of the present invention to provide an improved roller ball transfer device in which the user can grab a handle and perform various exercises such as curls, raises, squats, lunges, triceps kickbacks, etc., while also utilizing the rollers for various exercises.

It is another embodiment of many embodiments of the present invention to provide an improved exercise device having the ability to selectively add or remove weight, which can preferably be locked to the device when installed. The applicant is aware of no prior art roller devices, stationary devices, or rotational devices which have the ability to selectively add weight thereto.

It is another embodiment of many embodiments of the present invention to provide embodiments which can be utilized with various accessories such as but not limited to, ankle pads, grip width extensions, curl style bars, push up bars, knee pads and the like.

Accordingly, in accordance with a presently preferred embodiment of the present invention an exercise device is provided which preferably in many embodiments provides a series of weights in a predetermined amount such as five, ten, fifteen, etc., pounds, kilos or other denomination which can be connected directly to a roller, stationary, or rotational bar, transfer device, preferably one having a platen or base from which cross bars extend upwardly therefrom to connect to a handle. Downwardly relative to the base are preferably a plurality of ball transfers such at least three which may be spaced about a perimeter of the base or otherwise provided to support the weight of a user apply force to the handle. At least three ball transfers have been found helpful for many embodiments. Arms may extend cantileveredly from the base or otherwise to connect to the ball transfers unless the ball transfers are directly connected to the base for some embodiments.

Additionally, the handle and the cross bars may be connected internal to a well or depressed area relative to the mounting locations of the roller ball transfers or the base. A spacing bar, cross bar, ankle pad or a knee pad which may be connected to some of the devices for at least some embodiments preferably to the handle and/or cross bars. Some embodiments have various connection devices for securing the weights to the base and still other embodiments may be able to selectively connect and release tension bands thereto, such as to connect to the knee pad for at least some embodiments and for certain exercises to provide an assist for the individual for at least some exercises.

Some assemblies may have a base construction configured to be selectively detachable from the cross bar handle assembly. Other embodiments may have still other features such as a rotating disc, etc.

The applicant is unaware of any prior art design in which a roller ball transfer system is selectively connectable to an effective manner to weights so that not only can the device be utilized to traditional ball transfer exercise techniques, but also for such exercises as curls and other weighted exercise techniques, some of which may be somewhat unique to the devices of the preferred embodiments. Accordingly, a single work out device, such as that of various embodiments shown and described herein can provide multiple uses, or at least in a different way not yet available in the marketplace to use by other physical fitness devices.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENTS

Figure 1:
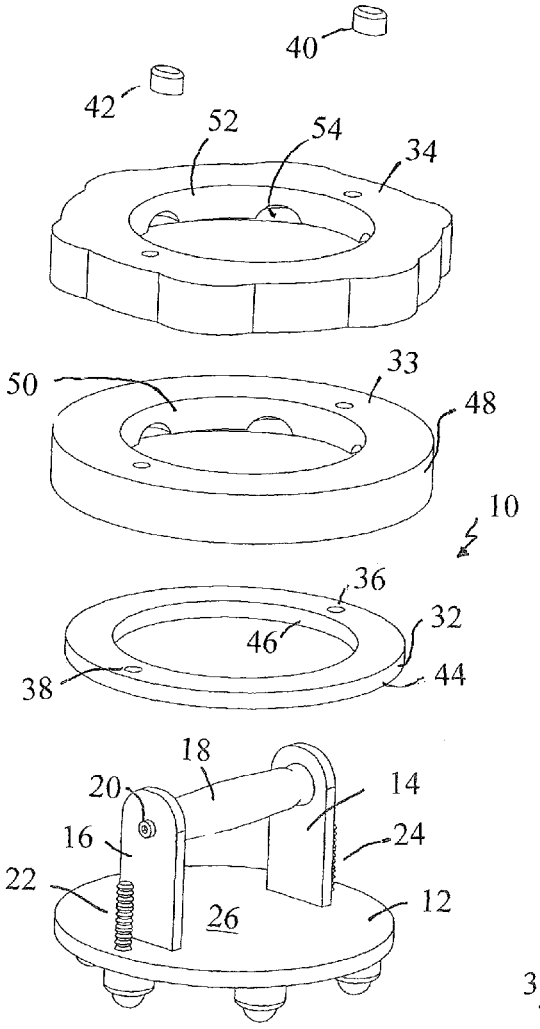
FIG. 1 is an exploded view of the presently preferred embodiment of the present invention showing an exercise device with yet to be added weights.
Figure 3:
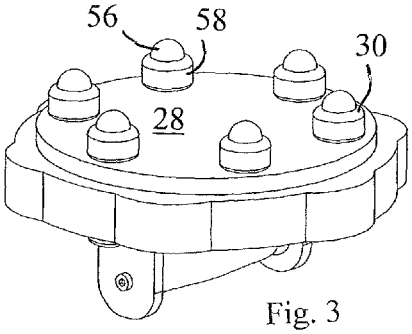
FIG. 3 is a bottom perspective view of the device shown in FIG. 1.

Platen or base 12 provides a structure from which upwardly extending cross bars 14,16 may extend relative thereto. Cross bars 14,16 may be symmetric but are preferably disposed to support a horizontally extending handle 18 which is preferably connected to the cross bars 14,16 either securely so that it does not move relative to the cross bars 14,16 or alternatively the handle 18 may rotate about axis 20 depending on the construction of the various embodiments. Cross bars 14,16 are preferably securely connected to the platen or base 12 for many embodiments. In the embodiment of FIG. 1, threaded rods 22,24 are shown upwardly extending relative to the platen or base 12 and may be secured thereto. Their use will be described in further detail below. The threaded rods are preferably upwardly extending relative to the base 12 to connect weights downwardly onto an upper surface 26 of the base 12. From a rear surface 28 of the base 12 as shown in FIG. 3, ball transfers 30 are shown disposed thereabout. In this embodiment six ball transfers 30 are shown equidistantly or even symmetrically disposed. Other numbers of ball transfers 30 such as preferably three or more are provided in various embodiments illustrated. It may be possible to have two or fewer other embodiments but the preferred embodiments of the presently preferred embodiments of the applicant's include at least three.

Figure 2:
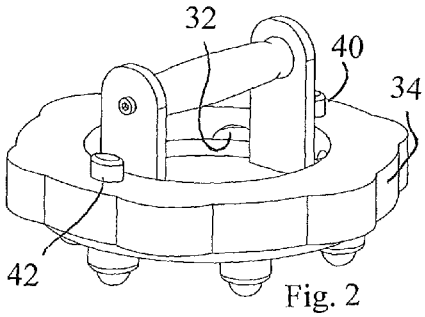
FIG. 2 is a front perspective view of the device of FIG. 1 in an assembled configuration utilizing at least one of the weights shown in FIG. 1.

Shown in FIG. 1 is also first weight 32, second weight 33 and third weight 34. The first weight 32 may be a five pound weight or other quantity of weight. The first, second and/or third weight 32,33,34 preferably have bores 36,38 which cooperate with threaded rods 22,24 to be received therethrough so as to secure the appropriate weight 32,33,34 to the device 10. Nut caps 40,42 or other nut may be utilized to make the secure connection such as is shown in FIG. 2 relative to the third weight 34 thereby securing it in position in a secured configuration from above against the base 12. First weight 32 and second weight 33 may have a constant radius for an outer circumference 44, and an inner circumference 46 just like the outer circumference 48 and inner circumference 50 for second weight 33. The third weight 34 may preferably have a constant radius, an inner circumference 52 but the outer circumference may take on various shapes for various embodiments. Still other embodiments may have varying shapes for the inner circumference 52,50,46 as well. Additionally, cutouts 54 may be useful for various uses of some embodiments as will be described below.

The ball transfers preferably have balls 56 which rotate and are at least partially encapsulated by socket 58 which may prevent their release as would be understood by those of ordinary skill in the art. As can be seen by reference to FIGS. 1-3, the weights for the first weight 32, second weight 33, and/or third weight 34 may be connected to the platen or base 12 from above with the inner circumferences 46,50,52 spanning radially externally to the cross bars 14,16 while being secured downwardly from above with the nut caps 40,42 to be secured in a downward fashion against the base 12. Multiple weights 32,33,34 may be simultaneously connected to base 12 for at least some embodiments. Multiple weights, 32,33,34 may be used in tandem with base, 12, nested together without base 12, or alone as individuals, 32,33,34 to perform various exercises such as curls, squats, dips, etc.

Figure 4:
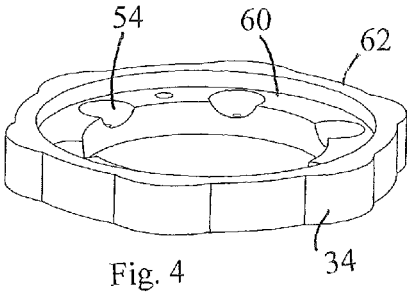
FIG. 4 is a bottom perspective view of a first weight shown in FIG. 1 removed from the device.

FIG. 4 shows the third weight 34 in showing the cutouts 54. These cutouts 54 are preferably configured to correspond at least to the number and position of ball transfers 30 with the same radial positioning so that the third weight 34 may be inverted as shown in FIG. 4 and then the ball transfers 30 placed therein so as to prevent movement for various exercises such as stationary pushups and the like, etc. As shown in FIG. 4, the cutouts 54 are preferably provided within a ledge 60 which extend at a lower elevation than bottom 62 of the first weight 34. By having the shelf or ledge 60, not only can the third weight 34 be connected to the device for the base 12 but also the first weight 34 may be nested within the third weight 34 as is shown in FIG. 2. Similarly, the second weight 32 provides similarly nesting capability as well in the preferred embodiment by also having the cutouts 54 provided for this embodiment shown in FIG. 4. Other embodiments may have different constructions.

Figure 5:
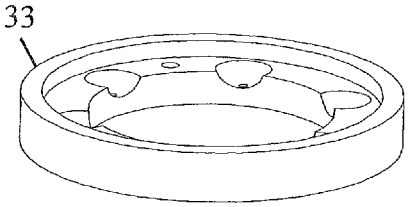
FIG. 5 is a bottom perspective view of a second weight shown removed from the device as shown in FIG. 1.
Figure 6:
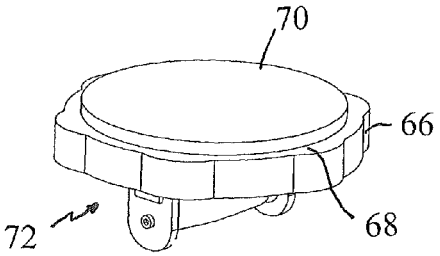
FIG. 6 is a bottom perspective view of a first alternative embodiment of the device shown in FIG. 1.

FIG. 5 shows the second weight 33. FIG. 6 shows an alternatively preferred embodiment which lacks the ball transfers 30. A fifteen-pound or other weight connected in the form of third weight 66 is illustrated connected to the upper surface 68 of base 70. This is a first alternative embodiment similar to the design of FIG. 1 for a device 72.

Figure 7:
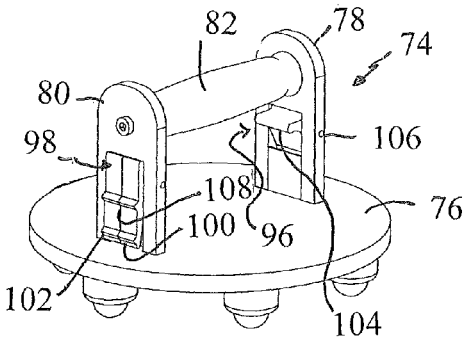
FIG. 7 is an exploded view of a second alternative embodiment of the device shown in FIG. 1.

A second alternative embodiment of device 74 is shown in FIG. 7 with a somewhat similar construction of that of FIGS. 1 and 6. This device 74 also has base 76, cross bars 78 and 80 upwardly extending thereto which connect to a handle 82. This device 74 is different in that the threaded posts 72,74 are preferably not provided with this embodiment. Instead, the weights which can be somewhat similarly configured are those of FIGS. 1-5 can be provided so that first weight 84, second weight 86 and third weight 88 may be disposed readily external to cross bars 78,80 such as with circumferences 90,92,94 extending radially external to the cross bar 78,80 and with the retainers 96,98 assisting in retaining the weights 84,86,88 in place. Specifically, as the first weight 84 is placed about the cross bar 78,80, the inner circumference 90 proceeds down below first lip 100 which preferably is biased in position shown in FIG. 1 but may be deflected inwardly by ramp 102 until released such as with lever 104 which when pulled upwardly results in a pivot action about pivot 106 to pull the lip 100 radially inwardly to then release the first weight 84.

Figure 8:
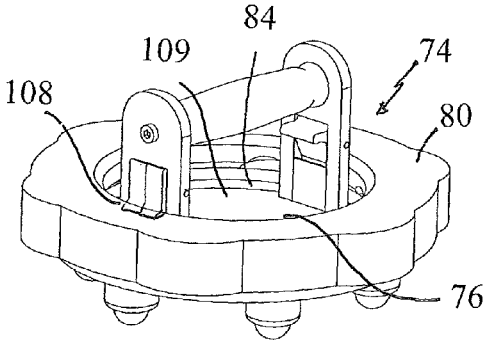
FIG. 8 is a top perspective view of the embodiment shown in FIG. 7.

A similar construction can be provided for the second lip 108 to release either of the second or third weights 86 or 88 respectively, if installed. Nesting can occur with the first weight 84 inside either of the second or third weights 86,88. Other embodiments may have other design considerations as well. With this embodiment, the user may relatively easily grasp the levers 104 as illustrated to release weights 84,86,88 to change the total weight of the device 74. FIG. 8 shows a connected version showing the third weight 88 connected at the upper surface 108 of the base 76 to provide the secure connection with the second lip 108 assembly in retaining that configuration as shown.

Figure 9:
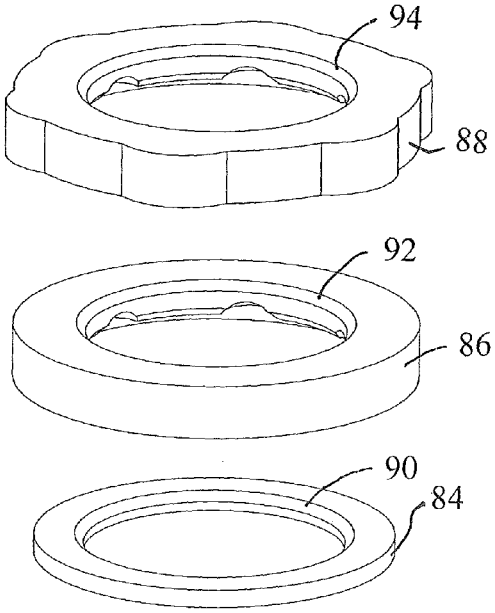
FIG. 9 is a bottom perspective view of the embodiment shown in FIGS. 7-8.
Figure 9:
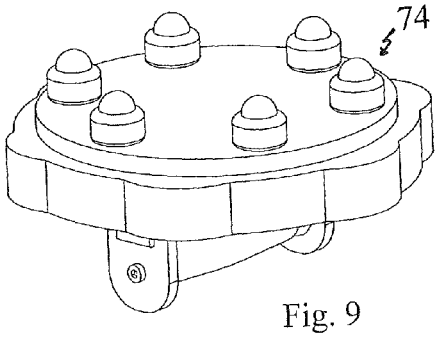
Figure 10:
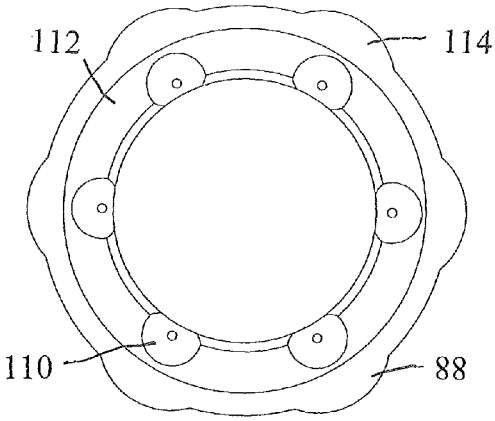
FIG. 10 is a bottom plan view of one of the weights shown in FIG. 7.

FIG. 9 shows a bottom view of the assembled device 74. FIG. 10 shows a bottom plan view better showing the cutouts 110 once again providing a ledge 112 which is above the bottom 114 of the second and third weights, in this case the third weight 88.

Figure 11:
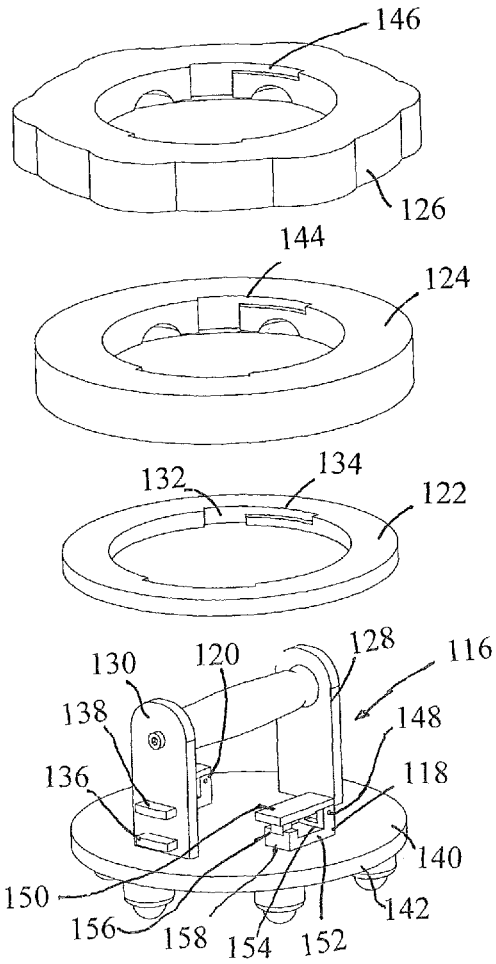
FIG. 11 is an exploded view of a third alternative embodiment of a presently preferred embodiment of the invention.
Figure 12:
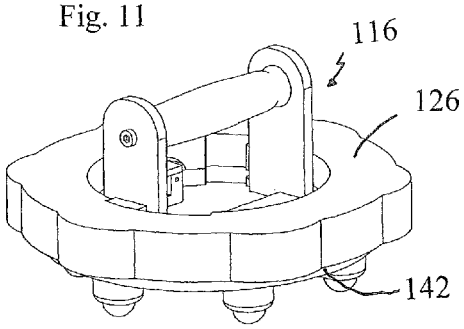
FIG. 12 is a front perspective view of the embodiment shown in FIG. 11 in an assembled construction.

FIG. 11 shows a third embodiment 116 of the device. This embodiment has clips 118,120 which may connect to resistance bands for various exercises. This embodiment also has a different method of securing the first, second and third weights 122,124,126 at cross bars 128,130. In this embodiment, the weights preferably have a vertically extending slot 132 connected to a trough 134 into which first or second projections 136,138 can be received. Specifically, the slot 132 is first positioned over the projections 136,138 so that the weights 124,126,128 can be downwardly pressed such as to contact upper surface 140 of the base 142 and then twisted so that the projections 136 and/or 138 respectively resides in the troughs 134,144 and/or 146 as would be appropriate. Meanwhile the clips 118,120 are shown with pivots 148 so that stop 150 may be moved relative to jaw 152 to assist in inserting and securing a band in passage 154 for at least some embodiments. A tooth 156 may engage a jaw 158 which may at least temporarily lock upon closure such as until a predetermined amount of force is placed on structure 150 to open the clip 118. Other embodiments may have other constructions for clips 118,120. FIG. 12 shows the third weight 126 connected to the base 142.

Figure 13:
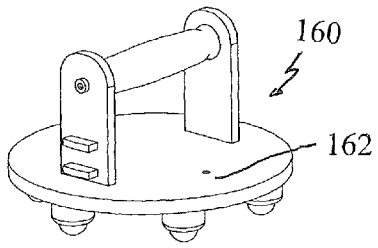
FIG. 13 is a front perspective view of a fourth alternative embodiment of the present invention.
Figure 15:
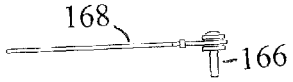
FIG. 15 is a side plan view of a connection system selectively utilized with the embodiments of FIGS. 13 and 14.
Figure 34:
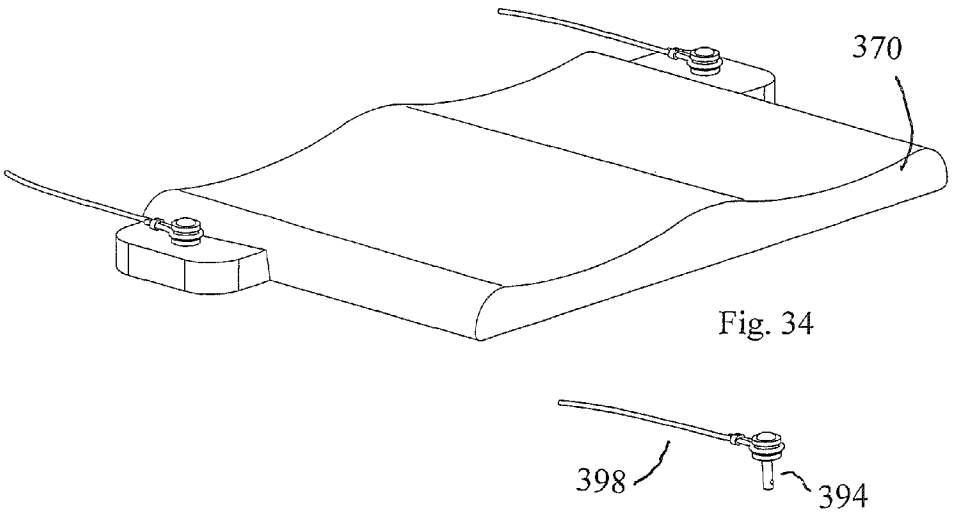
FIG. 34 shows a front perspective view of a knee pad to be used with the various embodiments of the presently preferred embodiment.

FIG. 13 shows still another embodiment of the present invention somewhat similar to that of the embodiment of FIG. 11 in that the device 160 in this embodiment has bores 162, 164 in base 166. These bores preferably receive pins 166 such as shown in FIG. 15 in a manner which could be similar to that as shown in reference to the knee pad construction of FIGS. 34,35 which will be described in further detail below. Pins 166 preferably connect to resistance bands 168 and can be used for various exercise such as connecting the bands 158 to the device 160 for two devices 160 to assist in pulling the devices 160 to a desired position such as various exercises might employ.

Figure 16:
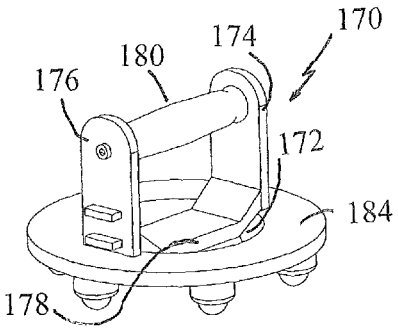
FIG. 16 is a fifth alternatively preferred embodiment of the present invention.
Figure 17:
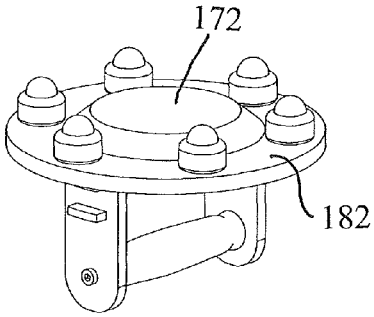
FIG. 17 is a bottom perspective view of the embodiment shown in FIG. 16.

FIG. 16 shows yet the fifth embodiment of the presently preferred embodiment 170. This embodiment provides a well 172 to which cross bar members 174,176 may partially downwardly extend thereinto and/or provide an additional space for one to extend down into to at least partially assist in lowering the center of gravity of device 170. Span 178 is shown connecting the cross bars 174,176 at least partially internal to the wells 132 for structural support and/or other purposes.

In the embodiment of FIG. 16, a force may be applied down into the span 178 such as by the user applying a force downwardly on the handle 180 to thereby lower the center of gravity of the entire device 170 which is preferably desirable for many applications. In this case, the span 178 may extend into well 172 which may be lower than a lower surface 182 of the base 184.

Figure 19:
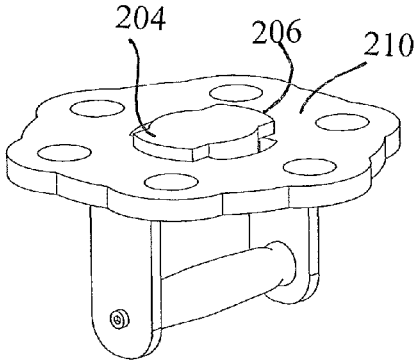
FIG. 19 is a bottom perspective view of the structure of FIG. 18 showing the roller ball elements removed.
Figure 20:
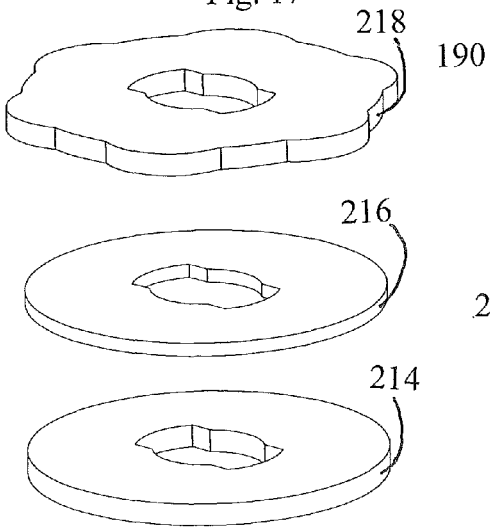
FIG. 20 shows a bottom perspective view of the embodiment of FIGS. 18-19 in an assembled configuration.
Figure 20:
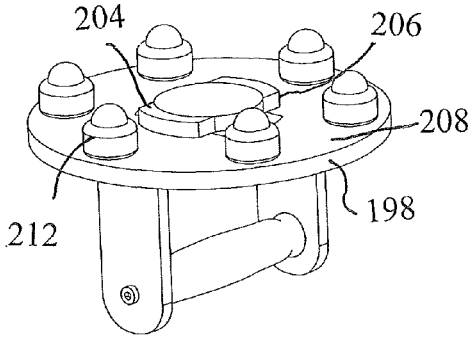
Figure 18:
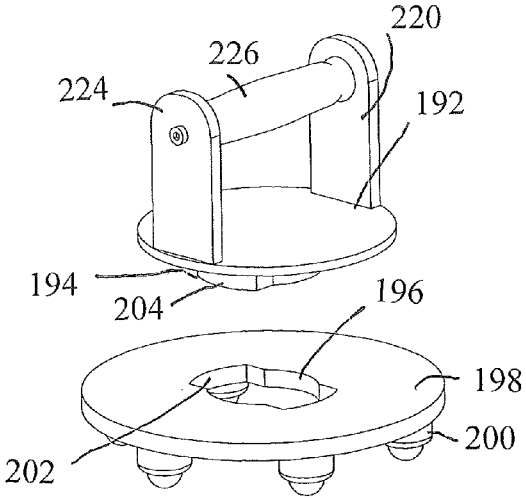
FIG. 18 is an exploded view of a sixth alternatively preferred embodiment of the present invention.

FIGS. 18-20 show another embodiment of the device 190. Device 190 preferably provides base 192 having a connector 194 which may cooperate with a receiver 196 and a platform 198 to which the ball transfers 212 are connected. The receiver 196 may have extensions 202 into which ears 204 can be initially received and then twisted relative thereto to provide a locking arrangement with ears 204,206 may be received and retained such as by lower surface 208 of the platform 198. Other embodiments may just allow for the connection of weight such as weight 210 but alternatively the weight 210 could also be the platform 198 with the ball transfers 212 unscrewed therefrom if so connected in such a manner. In this way, one may use the device 170 just as a dumbbell or alternatively as a ball transfer system. Once again, first, second and/or third weights 214,216,218 can cooperate with the device 190. Other number of weights may be used with this and/or other embodiments. In this embodiment the cross bars 220,224 upwardly extend from the base 192 to connect to the handle 226. The base 192 can connect with any of the various first, second or third weights 214,216, 218, etc. and/or platform 198 in this construction as would be understood by those of ordinary skill in the art.

Figure 21:
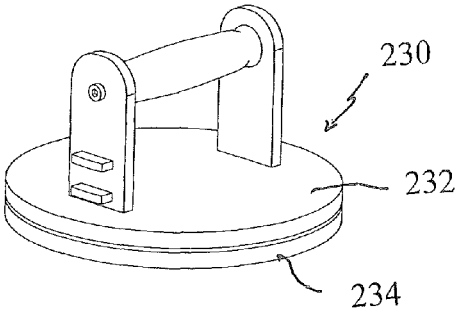
FIG. 21 shows a front perspective view of a seventh alternatively preferred embodiment of the present invention.

FIG. 21 shows yet another embodiment of the device 230 which does not have ball transfers. Instead, it has a base 232 connected to a rotating disk 234 to which base 232 rotates relative thereto such as with various or other structures disposed therebetween as would be understood by those of ordinary skill in the art.

Figure 22:
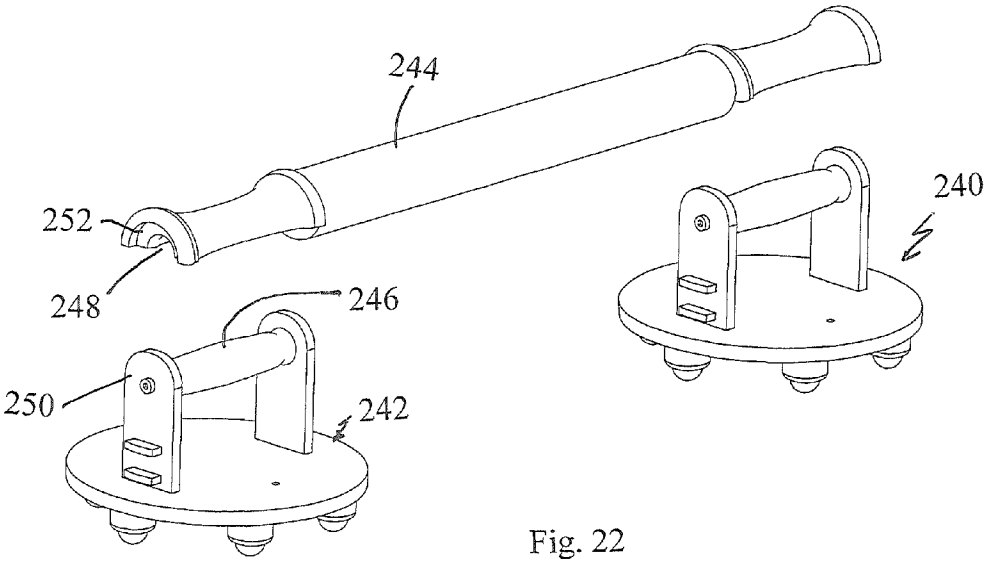
FIG. 22 shows an exploded view of a cross bar utilized with an embodiment of the presently preferred embodiment of the present invention.
Figure 23:
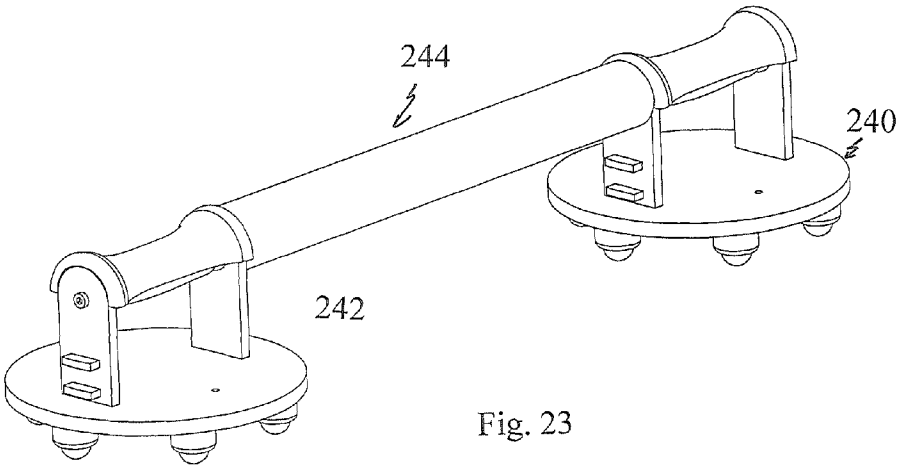
FIG. 23 shows a front perspective view of the structure shown in FIG. 22 in an assembled construction.

FIG. 22 shows two of the devices 240,242 spaced from one another and about to be connected to cross bar 244. The cross bar 244 connected to the devices 240,242 may provide either a curl bar or be used with different exercises for various embodiments.

The handle such as handle 246 is preferably received within trough 248 and potentially the cross bar such as cross bars 250 are received in depressions 252 to accommodate those extending structures for at least some embodiments.

Figure 26:
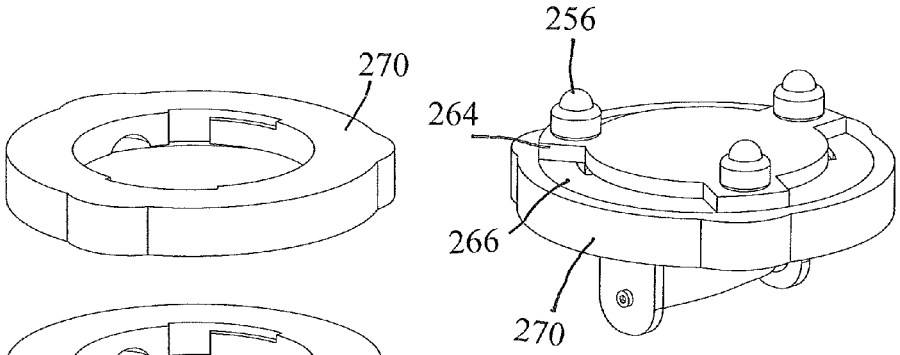
FIG. 26 is a bottom perspective view of the embodiment of FIGS. 24 and 25.
Figure 24:
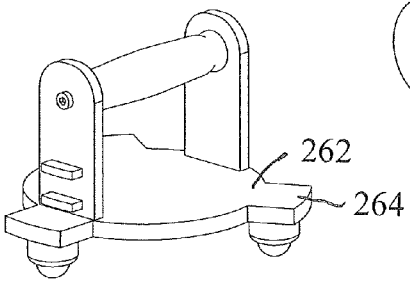
FIG. 24 shows an exploded view of an eighth presently preferred embodiment of the present invention.
Figure 25:
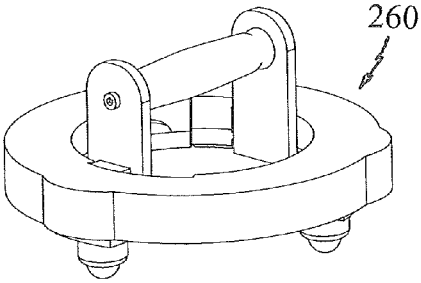
FIG. 25 shows a front perspective view of the embodiment of FIG. 24 in an assembled form.
Figure 28:
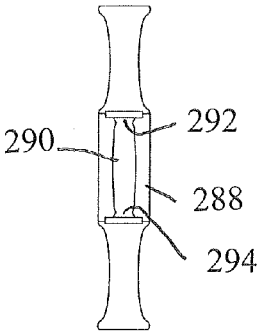
FIG. 28 shows a bottom plan view of the handle extension shown in FIG. 27.

FIGS. 24-26 show yet another embodiment of a device 260 which is a three roller ball embodiment. In this case, base 262 has cantilevered fingers or arms 264 extending therefrom to which the roller ball assembly 266 connect to assist in spreading out the roller ball 266 relative to the middle of the base 262 which can provide increased stability for at least some embodiments while also making the base 202 smaller for other embodiments. Additionally, in this embodiment, one can easily visualize the first weight 266 nested within the third weight 270. This is also possible by nesting the first weight 266 within the second weight 268 as would be understood by those of ordinary skill in the art. All of the applicant's designs preferably nest first weights 266 in second and third weights 268 and 270. Other embodiments may be constructed similarly or dissimilarly. All the three weights 266,268,270 could be or other weight combinations and/or more than three weights could be connected in a similar system as would be understood by those of ordinary skill in the art.

Figure 27:
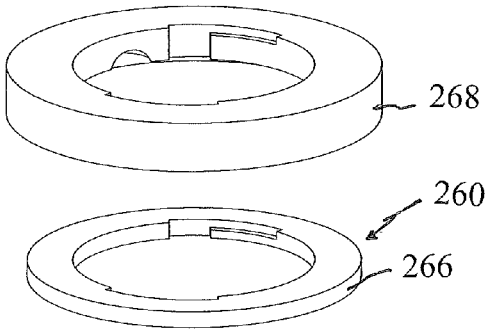
FIG. 27 shows a front plan view of a handle extension connected to one of the embodiments of the present invention.
Figure 27:
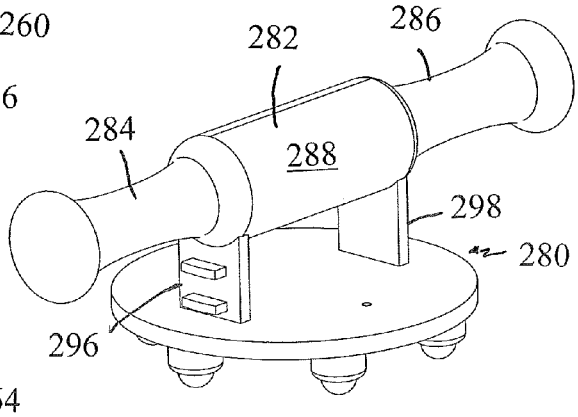

FIG. 27 shows a device 280 connected to a handle extender 282. This device has hand positions 284,286 spaced by a spacer 288 to provide a wider hand grip and so the two hand positions 284,286 are provided instead of a single handle on the device 280. Hand positions 284,286 are located about the spacer 288 as would be understood by those of ordinary skill in the art. In fact, spacer 288 may have trough 290 as well as cutouts 292,294 to receive the cross bars 296,298. While the handle is obscured from view in this figure, it would be understood by those of ordinary skill in the art with reference to the other embodiments and figures shown herewith.

Figure 29:
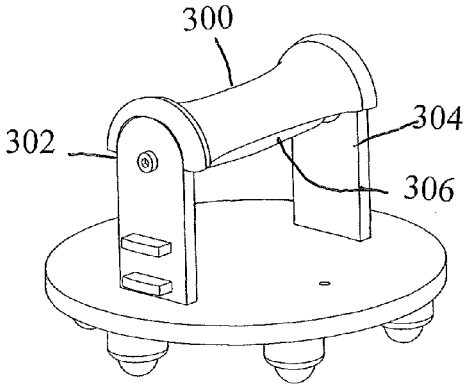
FIG. 29 shows a front perspective view of an ankle rest connected to one of the preferred embodiments of the present invention.
Figure 30:
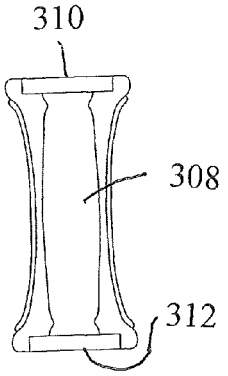
FIG. 30 shows a bottom plan view of the ankle rest shown in FIG. 29.

FIGS. 29 and 30 show a heel rest 300. This embodiment is connected to cross bars 302 and/or 304 as well as possibly handle 306. This provides a place for ones feet or heel to rest upon for various exercises. FIG. 30 shows the trough 308 and the cutouts 310 and 312 into which the handle and the cross bars 302,304 may be received. Heel rest 300 could be connected to handle 306 such as by friction fit and/or various other connections similarly or dissimilarly to handle extender 282 and/or other accessories. Preferably the accessories such as the heel rest 100 and the handle such as handle extender 282 and the cross bar 244 and others can be similar constructions as would be understood by those of ordinary skill in the art for at least some embodiments.

Figure 31:
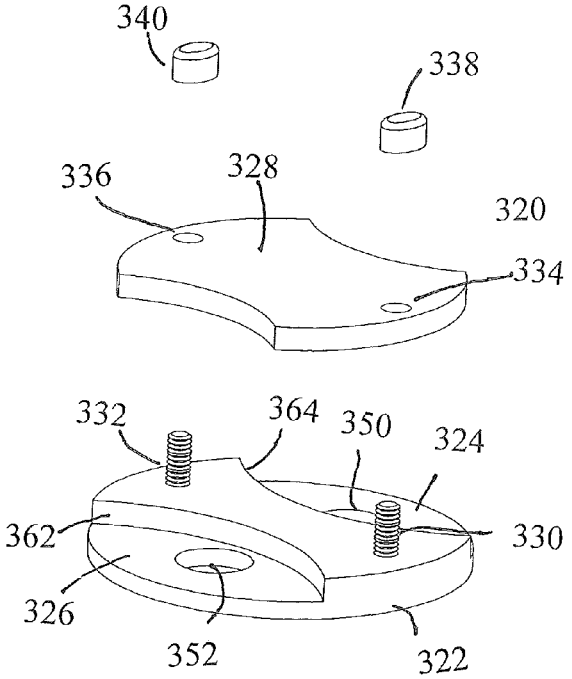
FIG. 31 shows an exploded view of a base connector to be utilized with two of the embodiments shown above.
Figure 32:
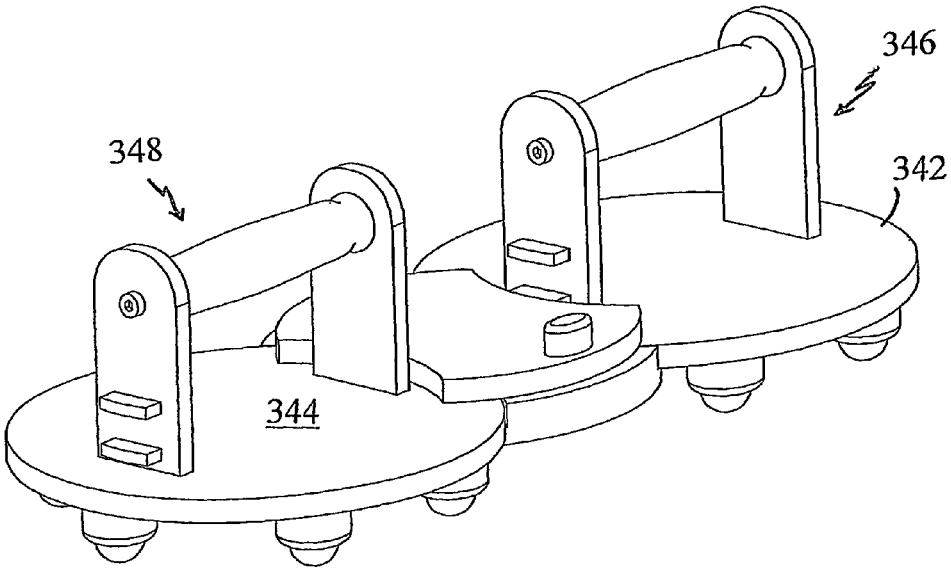
FIG. 32 shows a front perspective view of the base connector assembled to two devices shown above.
Figure 33:
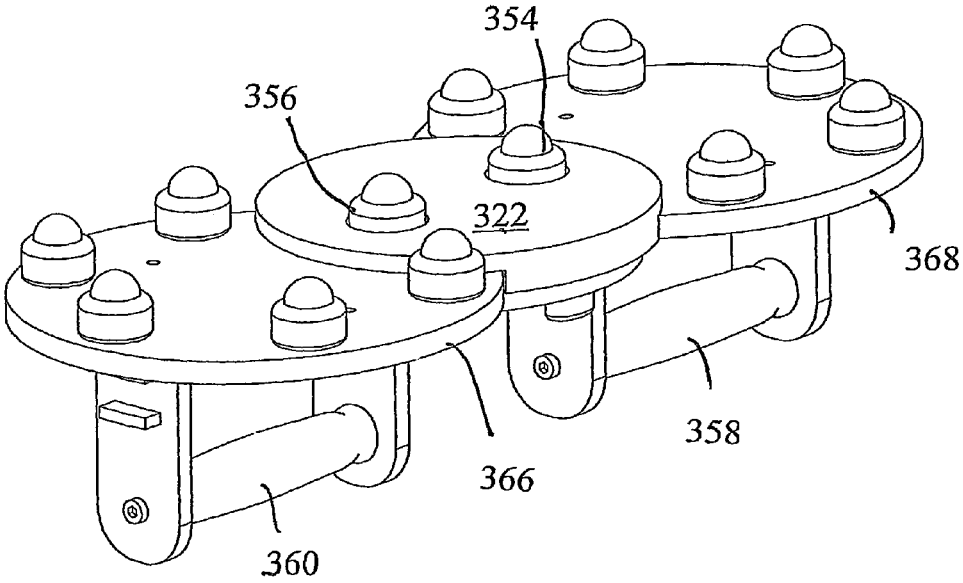
FIG. 33 shows a bottom perspective view of the embodiment of FIGS. 32 and 33.

FIGS. 31-33 show a base connection clamp 320 which preferably has bottom 322 having receivers 324 and/or 326 which may be provided therewith as well as a top 328. Threaded rods 330,332 may be received within bores 334,336 and secured with nuts caps 338,340 to assist in entrapping bases 342,344 of two devices 346,348 together such as is shown in FIG. 32. Other connection systems may be used with other embodiments. Bores 350,352 may respectively receive a ball transfer such as ball transfers 354,356 such as is shown in FIG. 33. Although the handles 358,360 are shown being parallel, it should be obvious to one of ordinary skill in the art that depending on which of the ball transfers 354 or 356 of the two devices 346,348 are selected, the handles 358,360 can be rotated at increments of 60 degrees relative to one another for this embodiment. Depending on the placement of the ball transfers on the devices 346,348, various angles or relationships of the handles 358,360 could be provided. This allows not only traditional style pushups to be performed or curls such as are shown in FIG. 2 but angled curl bars could be provided as well as angled push ups and/or other exercise techniques used in this embodiment. A receiving circumference is 362,364 preferably provided which may cooperate with the outer circumferences 366,368 of the bases 342,344 in order to facilitate a secure fit and the angular selection for at least some embodiments.

Figure 14:
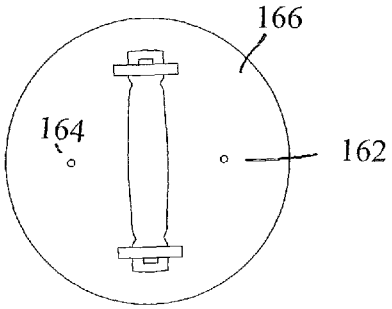
FIG. 14 is a top plan view of the embodiment shown in FIG. 13.
Figure 35:
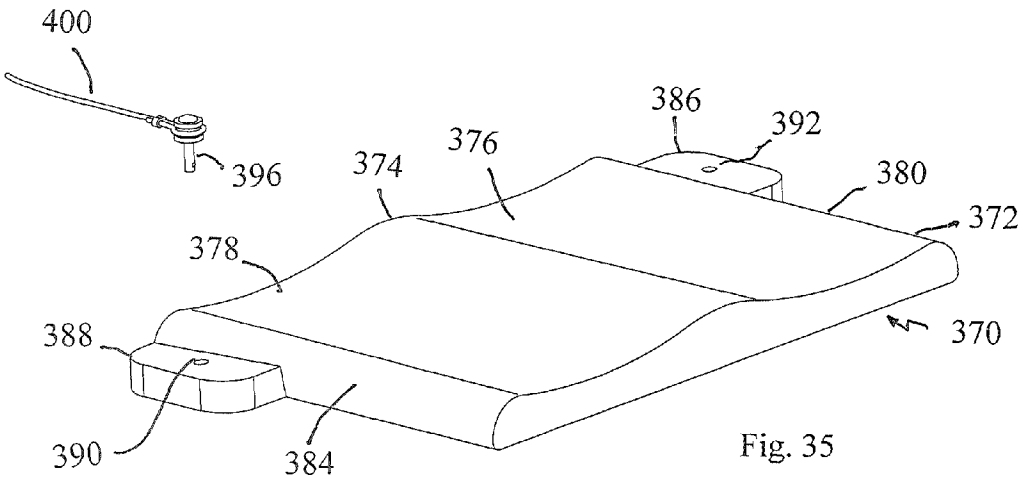
FIG. 35 shows an exploded view of the structure of FIG. 34.

Finally, as shown in FIG. 35, knee pads 370 not only have an upper surface 372 for receiving the knees which may be divided by ridge 374 into valleys 376,378 possibly bounded by ridges 380,384 but also feet 386,388 which may have bores 390,392 to receive pin connectors 394,396 or other connections which could also utilize connect bands 398,400 which could be the same bands connected to the device of FIGS. 13-15 as described above.

Not only can the various embodiments of the device be used for curls or other exercises having handles, but the preferred embodiments of the present invention can also be used as push up devices as is known in various art as well as for doing a number of other exercises such as with legs, arms and/or other parts of the body including chest, possibly back and/or legs or a large number of possibilities of use. Also although ball transfers are illustrated, casters, rollers and/or rolling assemblies could be employed for other embodiments.

The applicant has been unable to find any exercise roller assembly which provides an ability to selectively connect one or more weights securely thereto, particularly when the weights are securely fastened to an upper portion of the assembly while still allowing the handles to be gripped and used.

Figure 36:
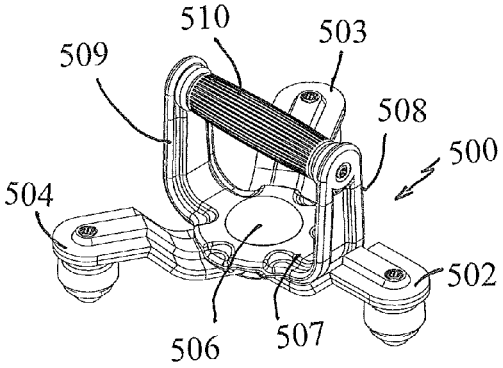
FIG. 36 is a front perspective view of a ninth alternative embodiment of the present invention.
Figure 39:
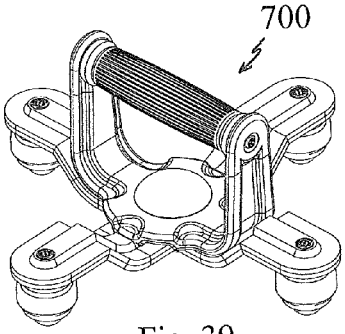
FIG. 39 is a front perspective view of a tenth alternative embodiment of the present invention.
Figure 37:
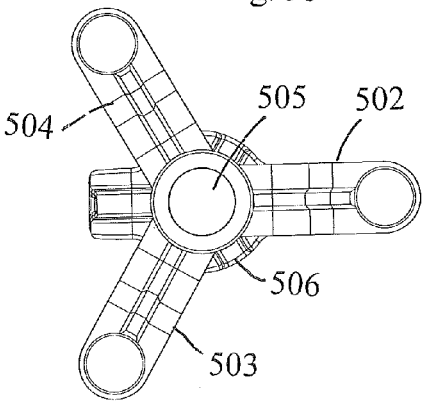
FIG. 37 is a bottom plan view of the embodiment shown in FIG. 36.
Figure 40:
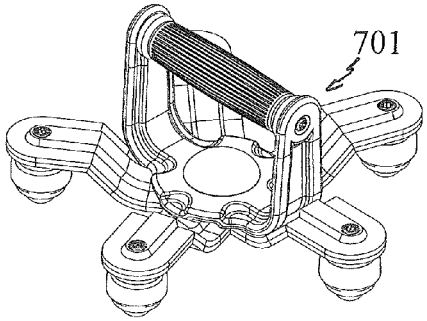
FIG. 40 is a front perspective view of an eleventh alternative embodiment of the present invention.
Figure 38:
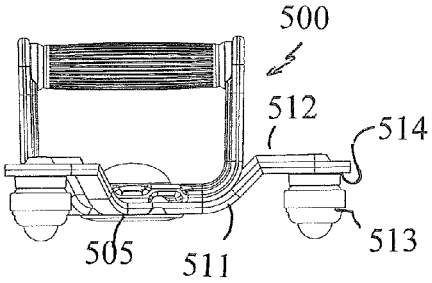
FIG. 38 is a side plan view of the embodiments shown in FIGS. 35-37.
Figure 41:
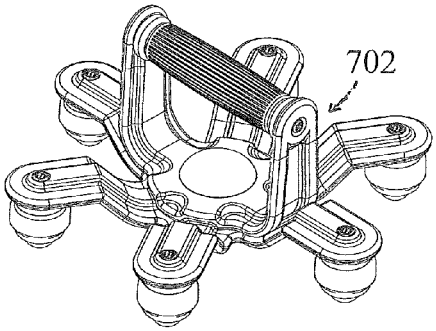
FIG. 41 is a front perspective view of a twelfth alternative embodiment of the present invention.
Figure 42:
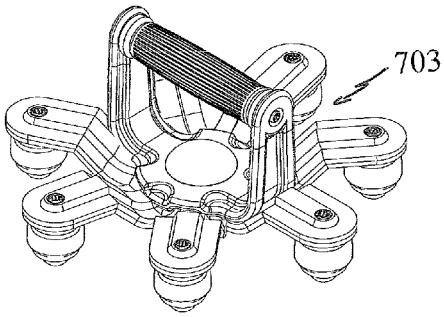
FIG. 42 is a front perspective view of a thirteenth alternative embodiment of the present invention.
Figure 45:
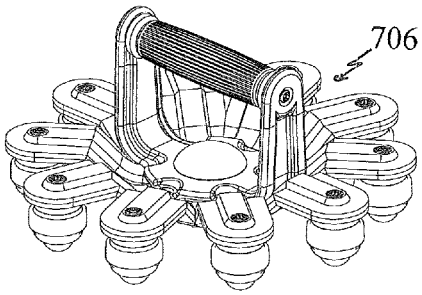
FIG. 45 is a front perspective view of a sixteenth alternative embodiment of the present invention.
Figure 43:
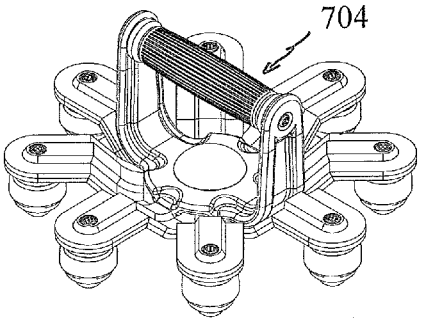
FIG. 43 is a front perspective view of a fourteenth alternative embodiment of the present invention.

FIGS. 36-38 show a ninth alternatively preferred embodiment of an exercise device 500 with three legs 502,503,504 connected to base 505. Handle assembly 506 may rotate relative to base 505 for at least some embodiments. For other embodiments, handle assembly 506 may be rigidly connected to, if not an integral part of base 505. Handle assembly 506 may also include disc 507 from which cross bars 508,509 extend to then support handle 510 therebetween.

Unlike the other embodiments described above, this embodiment has legs 302-304 which extend from the base 505, and then extend upwardly along backs 511 to shelves 512 from which the rollers 513 then connect to a bottom surface 514 of the shelves 512 for at least some embodiments. This, for at least some embodiments, allows the center of gravity to be lower than would be experienced if the legs were made to be coplanar with the base, as occurs with many other embodiments. As shown in FIG. 38, for at least some embodiments, the bottom surface 514 may be above the base 505, as well as above the disc 507, such as completely above. Other embodiments may not address the center of gravity to such an extreme. Still other embodiments may have other leg configurations and/or features not shown or described herein.

The embodiment of the exercise device 500 is a three legged configuration. Other embodiments, such as those shown in FIGS. 39-45 show four through ten legged embodiments as devices 700, 701, 702, 703, 704, 705, and 706, respectively. It may be possible to have up to, or even exceeding twelve legged embodiments for some designs.

Figure 46:
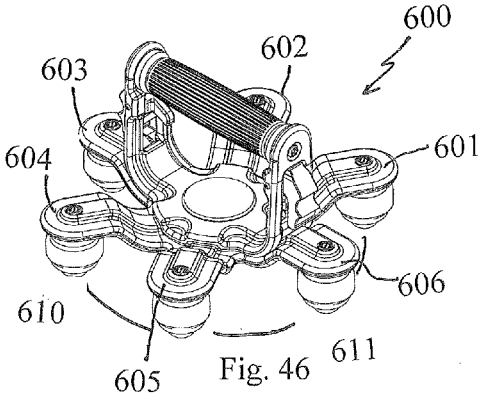
FIG. 46 is a front perspective view of a seventeenth alternative embodiment of the present invention.
Figure 44:
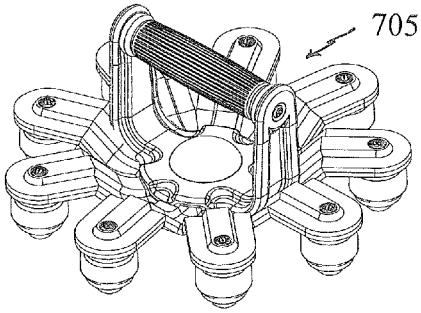
FIG. 44 is a front perspective view of a fifteenth alternative embodiment of the present invention.
Figure 47:
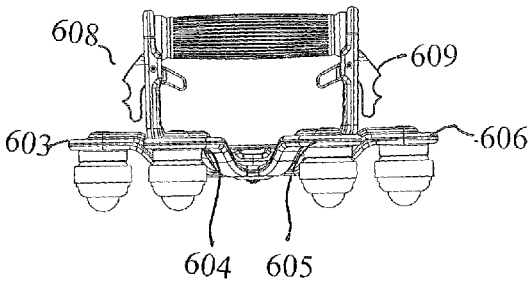
FIG. 47 is a front plan view of the embodiment shown in FIG. 46.
Figure 48:
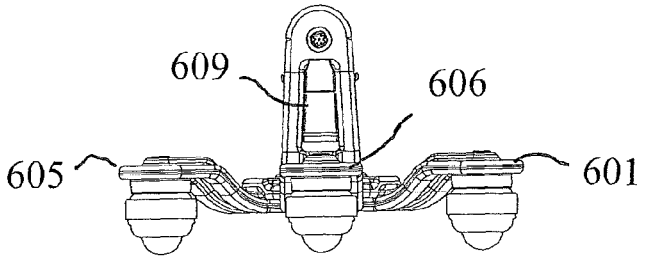
FIG. 48 is a side plan view of the embodiment shown in FIGS. 46-47.
Figure 49:
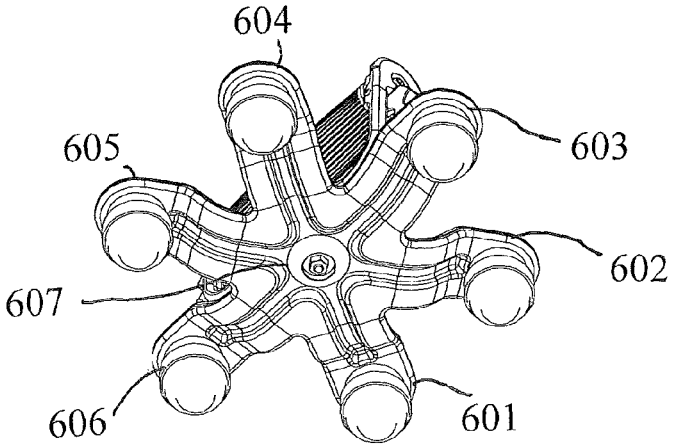
FIG. 49 is a bottom perspective view of the embodiment shown in FIGS. 46-48.

FIG. 46 shows a six legged exercise device 600. This device has six legs 601-606. These legs are illustrated of similar construction of those shown in FIGS. 36-45 but could be constructed differently for other embodiments. Other features are similar to the embodiment of FIGS. 36-38, except that features from the embodiment of FIGS. 7-9 is also included in this embodiment to provide an easy way to add and release added weight from above the base 607 with retainers 608, 609 which are illustrated as functionally similar to the retainers 96,98 shown in FIGS. 7-9 and could receive the weight rings such as those weights 84,86,88 shown in FIGS. 7-9 or other configurations of weights, for at least some embodiments.

FIG. 46 shows rollers 612 equally spaced about circumference segments 610,611 of a circumference extending through the rollers 612. For all of the illustrated embodiments a circumference extends through the illustrated rollers, although other embodiments could have additional rolling devices located outside of the circumference (either within it or externally disposed thereto).

Figure 50:
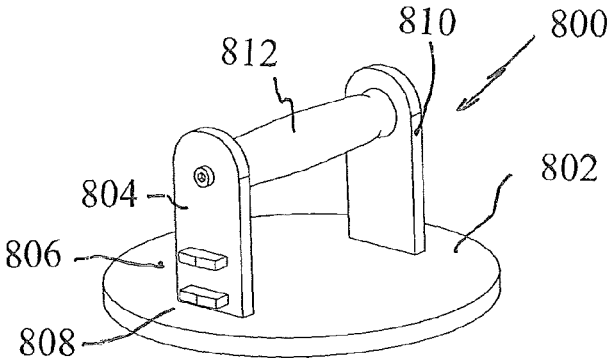
FIG. 50 is a top perspective view of an eighteenth alternative embodiment of the present invention.

FIG. 50 shows an embodiment of the device 800 which is a non-roller based model. In fact, this embodiment may be stationary when used on a horizontal surface, such as a floor for push-ups. Base 802 is shown connecting to cross bars 804,810 supporting handle 812 as occurs with many other embodiments. Weight retainer(s) such as, or different from, those illustrated as projections 806,808 can be like projections 138,136 as described above, or take on structures as shown throughout this application to hold weights (such as the embodiments illustrated) when added as described herein, or as would be understood to be within the scope of this invention by those of ordinary skill in the art.

Figure 51:
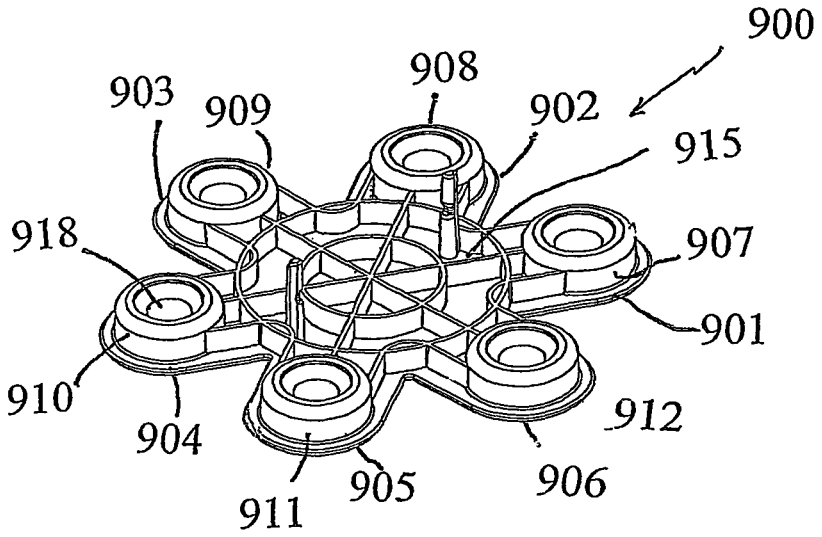
FIG. 51 is a top perspective view of a nineteenth embodiment which is a roller stop usable with many embodiments shown above such as the embodiments of FIGS. 1-3, 7-9, 11-20, 22-23, 27, 29,32-33, 41, and 46-49.
Figure 52:
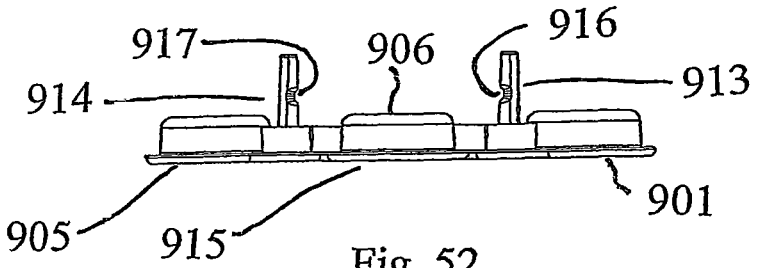
FIG. 52 is a side plan view of the embodiment of FIG. 51.
Figure 53:
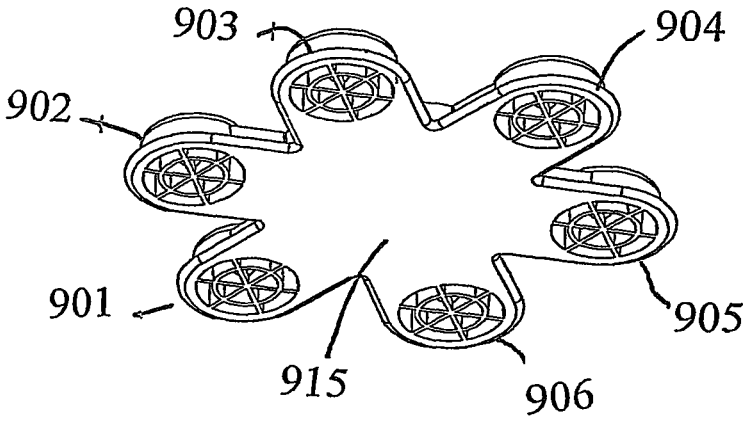
FIG. 53 is a bottom perspective view of the embodiment shown in FIGS. 51 and 52.

FIGS. 51 and 52 are top and bottom perspective view of a nineteenth embodiment which is a floor protector and/or roller stop 900. The roller stop 900 may or may not have six legs, illustrated as legs 901-906. The roller stop may have up to, as many, or even more roller receivers 907-912 as rollers in the various devices such as, such as rollers 56,256 used with the various devices 10,74, etc. Fingers 913,914 may upwardly extend relative to hub 915 and possibly be provided with slots 916,917 to potentially assist in retaining the roller stop 900 to the device 10,74 used with the roller stop 900. The roller stop 900 would then be useful to prevent rolling of the various device(s) 10,74, etc. under certain conditions, for instance, for use with certain exercises. The illustrated embodiment is just one design. Not all embodiments will necessarily provide cups 918 in all, or even any of the roller receivers 907-912.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An exercise device comprising:
a base connected to upwardly extending cross bars;
a handle connected to an extending between the cross bars;
wherein connected to the base are at least three rollers extending and directed downwardly below the base with the rollers spaced radially outwardly relative to and beyond the cross bars along a circumference extending through the rollers;
at least one retainer, said retainer at least selectively retaining at least one of first, second and third weight rings circumferentially about the cross bars; and
a first lip on the retainer, said first lip extending above and on the first weight when the first weight is connected to the exercise device.

2. The exercise device of claim 1 further comprising a second lip on the retainer and a second weight, said second lip extending above and on the second weight when the second weight is connected to the exercise device, said second lip spaced elevationally above the first lip.

3. The exercise device of claim 2 further comprising a level release, wherein upon movement of the level to a release position, at least one of the first and second lips disengages one of the first and second weights.

4. An exercise device:
a base connected to upwardly extending cross bars;
a handle connected to an extending between the cross bars;
wherein connected to the base are at least three rollers extending and directed downwardly below the base with the rollers spaced radially outwardly relative to and beyond the cross bars along a circumference extending through the rollers;
at least one retainers, said retainer at least selectively retaining at least one of first, second and third weight rings circumferentially about the cross bars;
a first lip on the retainer, said first lip extending above and on the first weight when the first weight is connected to the exercise device;
a second lip on the retainer, said second lip extending above and on the second weight when the second weight is connected to the exercise device, said second lip spaced elevationally above the first lip;
wherein the second weight has cutouts therein, said cutouts, when upwardly directed, are spaced to receive the rollers therein.

5. An exercise device comprising:
a base connected to upwardly extending cross bars;
a handle connected to an extending between the cross bars;
wherein connected to the base are at least three rollers extending and directed downwardly below the base with the rollers spaced radially outwardly relative to and beyond the cross bars along a circumference extending through the rollers; and
a weight configured to connect to the device in an installed configuration and having cutouts therein, said cutouts, when upwardly directed, are spaced to receive the rollers therein in a restraining configuration.

6. An exercise device comprising:
a base connected to upwardly extending cross bars;
a handle connected to an extending between the cross bars;
wherein connected to the base are at least three rollers extending and directed downwardly below the base with the rollers spaced radially outwardly relative to and beyond the cross bars along a circumference extending through the rollers;

at least one of first, second and third weights configured to be secured to the device from above along an upper surface of the device with at least one retainer, said at least one retainer pivotably connected to at least one of the cross bars and having a first lip on the retainer, said first lip extending above and on the first weight when the first weight is connected to the exercise device.

7. The exercise device of claim 6 further comprising a second lip on the retainer and a second weight, said second lip extending above and on the second weight when the second weight is connected to the exercise device, said second lip spaced elevationally above the first lip.

8. An exercise device comprising:

a base connected to a disc connected to and supporting two spaced apart upwardly extending cross bars, said disc having an engaged and a disengaged configuration with the base with the disc operably coupled to the base in the engaged configuration and removed from contact with the base in the disengaged configuration;

a handle connected to and extending between the cross bars;

wherein connected to the base are at least three rollers extending and directed downwardly below the base with the rollers spaced radially outwardly relative to and beyond the cross bars along a circumference extending through the rollers, and the disc is bounded by and located internally to the circumference extending through the rollers.

9. The exercise device of claim 8 wherein the disc is rotatably connected to the base, wherein the handle is rotatable relative to the base and rollers.

10. The exercise device of claim 8 wherein the rollers respectively connect to legs which extend from the base.

11. The exercise device of claim 10 wherein the legs extend radially away from the base.

12. The exercise device of claim 11 wherein the legs extend upwardly along back segments to shelves, and the rollers connect to the shelves above the base.

13. The exercise device of claim 12 wherein the cross bars extend elevationally below a bottom surface of the shelves.

14. The exercise device of claim 8 further comprising at least one retainers, said retainer at least selectively retaining at least one of first, second and third weight rings circumferentially about the cross bars preventing upward movement of the weights relative to the rollers.

15. The exercise device of claim 14 wherein the at least one retainer pivotably connects to at least one of the cross bars.

16. The exercise device of claim 14 further comprising a first lip on the retainer, said first lip extending above and on the first weight when the first weight is connected to the exercise device.

17. The exercise device of claim 16 further comprising a second lip on the retainer and a second weight, said second lip extending above and on the second weight when the second weight is connected to the exercise device, said second lip spaced elevationally above the first lip.

18. The exercise device of claim 8 configured to receive at least one of first, second and third removably connected weights from above to be secured to the device along an upper surface of the device radially outwardly of the spaced apart cross bars.

19. The exercise device of claim 18 further comprising radially extending legs and the at least one of the first second and third weights are secured with at least one retainer to an upper surface of the legs.

20. The exercise device of claim 18 wherein the at least one retainer pivotably connects to at least one of the cross bars thereby securing the at least one of the first second and third weights preventing upward movement of the at least one of the weights relative to the device.

* * * * *